United States Patent [19]

Roach

[11] Patent Number: 5,063,378

[45] Date of Patent: Nov. 5, 1991

[54] SCANNED LIQUID CRYSTAL DISPLAY WITH SELECT SCANNER REDUNDANCY

[75] Inventor: William R. Roach, Rocky Hill Borough, Somerset County, N.J.

[73] Assignee: David Sarnoff Research Center, Inc., Princeton, N.J.

[21] Appl. No.: 455,191

[22] Filed: Dec. 22, 1989

[51] Int. Cl.[5] ..... G09G 3/18

[52] U.S. Cl. ..... 340/784; 340/800

[58] Field of Search ..... 340/784, 718, 719, 811, 340/800, 715

[56] References Cited

U.S. PATENT DOCUMENTS

| | | | |
|---|---|---|---|
| 4,368,523 | 1/1983 | Kawate | 365/63 |
| 4,427,978 | 1/1984 | Williams | 340/784 |
| 4,633,242 | 12/1986 | Sekiya | 340/715 |
| 4,660,030 | 4/1987 | Maezawa | 340/784 |
| 4,679,043 | 7/1987 | Morokawa | 340/784 |
| 4,694,348 | 9/1987 | Kamiya | 358/236 |
| 4,742,346 | 5/1988 | Gillette | 340/793 |
| 4,766,430 | 8/1988 | Gillette | 340/793 |
| 4,779,086 | 10/1988 | Kanno | 340/805 |
| 4,804,953 | 2/1989 | Castleberry | 340/784 |

OTHER PUBLICATIONS

"Using Redundancy When Designing Active-Matrix-Addressed LDCs", S. Bisotto, *Proceedings of the SID*, vol. 26/3, 1985, pp. 201-207.

*Primary Examiner*—Alvin E. Oberley
*Assistant Examiner*—Matthew Luu
*Attorney, Agent, or Firm*—William J. Burke

[57] ABSTRACT

A liquid crystal device (LCD) display includes a grid of conductive row select lines and column data lines which are used in conjunction with thin-film transistors (TFT's) to address pixel electrodes in the display. The LCD display includes two shift registers for receiving and propagating the select signals for the row select lines, each shift register has a plurality of shift register stages, one connected to each row select line. A plurality of combiner circuits are provided, one for each stage of each of the shift registers. Each combiner circuit is configured to provide an electrical conduction path for the select signal between successive stages in each of the shift registers. When a fault is detected in a stage of one of the shift registers, the combiner circuit coupled to the output of the defective stage reconfigured to route the select signal from the corresponding stage of the other shift register to the next stage of the one shift register. Full select shift register redundancy is provided, even if both shift registers have faulty stages.

9 Claims, 6 Drawing Sheets

Fig. 2 SHIFT REGISTER AND COMBINER CIRCUITS.

LCD CELL

LCD with Redundant Select Scanner on One Side

LCD with Two Redundant Select Scanners

SCANNED LIQUID CRYSTAL DISPLAY WITH SELECT SCANNER REDUNDANCY

BACKGROUND OF THE INVENTION

1. Field of the Invention

The present invention relates generally to Liquid Crystal Device (LCD) video displays and more particularly to the use of redundant, integrated select line driver circuitry in the fabrication of a scanned active matrix (AM) LCD.

2. Description of the Prior Art

LCD displays offer benefits which are not achievable in conventional cathode ray tube displays. LCD thinness, low weight, low power consumption and ruggedness are advantageous for a variety of applications, ranging from portable personal computers to avionics displays.

LCD displays which use twisted nematic liquid crystal material are well known. In display systems of this type, the liquid crystal molecules align themselves in the absence of an electrical field in such a manner as to twist polarized light to pass through an exit polarizer. In the presence of an electric field, the crystals align themselves so that polarized light is not twisted and will be blocked by the exit polarizer. Thus, for a back-lighted LCD display, a viewer sees a lighted pixel in the absence of an electric field and a dark pixel in the presence of an electric field.

Individual pixels in some LCD displays are activated using active matrix (AM) technology. In AM LCD display devices, an active device (for example, a thin film transistor or TFT) is present at each pixel site. In a scanned AM LCD display, the gate contacts of the transistors are attached to select lines (also known as gate lines), the source contacts of the transistors are connected to data lines, and the drain contact of each transistor is connected to one plate of capacitor formed by a liquid crystal dielectric layer sandwiched between two electrodes, at least one of which is transparent. The AM matrix display is scanned one row (line) at a time by applying a select voltage value to the select line associated with that row. In response to the select voltage, the TFT's in the row are conditioned to charge their respective capacitors to the potential values supplied by the respective data lines. These charge values change the electric field applied to the LC material and, so, lighten or darken the individual pixel cells in the row. When all of the rows of the matrix have been scanned, an image is formed on the LCD matrix.

In integral scanned AM LCD arrays, the scanning and data logic are formed directly on the substrate on which the individual pixel capacitors and TFT's are formed. The data logic may include, for example, a shift register and a parallel data register to hold the data values for one line of the display. The select logic may include a shift register for propagating the select signal from the top line position of the display to the bottom line position in one frame interval.

An underlying problem in the development of large AM LCD panels is the difficulty of reliably addressing a single pixel through this data and select logic and through the relatively large electronic grid of data and select lines. In contrast to a CRT, in which a pixel may be addressed simply by directing an electron beam electrically and magnetically to a desired spot, the LCD display includes the data and select logic as well as a pair of conductive paths for each pixel.

As the panel size increase, the complexity of the data and scanning logic and of the conductive paths increases. Furthermore, as pixel density increases, smaller components in the data and scanning logic and thinner conductive paths become more desirable. These two effects make the reliability of the data and scanning logic and of the conductive paths an important issue in the fabrication of an LCD display.

U.S. Pat. No. 4,804,953 to Castleberry discusses a method for providing redundancy in the data and gate lines between the LCD cells. The data lines and the gate lines are formed during each of two metalization steps to provide the desired redundancy. The first conductive data line layer is fabricated in the same process stage as the silicon gate electrodes of the TFT switching elements. An insulating layer is fabricated in the same process stage as the gate insulating material. The second conductive layer for the data lines is fabricated in the same process stage as the source and drain metalizations. The two conductive layers are in contact along approximately 90 percent of the length of each data line.

U.S. Pat. No. 4,368,523 to Kawate discusses an LCD device fabricated with redundant pairs of data and select lines. In this configuration, each cell of the LCD display includes four TFT switches, one for each possible combination of data and select lines. Any of these four switches may control the cell. When a defective TFT, data line or select line is detected during testing, it may be cut away using a laser, leaving the other three TFT's, the other data line and/or the other select line active. Thus, this apparatus may recover from multiple failures in the data or select lines and in the TFT switches.

As the reliability of the electronic grid of select and data lines increases, other failure mechanisms become dominant in limiting the yield of AM LCDs. For externally scanned LCD's a failure in the numerous connections between the display device and the external data and scanning logic is one of these failure mechanisms. When the row and column drivers are external to the display matrix, the driver to matrix connections can limit the system reliability. The problem increases as the size of the panel (and the number of driver-to-matrix interconnections) grows larger.

When the select line and data line driver circuits are integrated onto the glass substrate, along with the AM display (i.e. an integral scanned AM display), the number of external connections may be reduced by 70 percent or more, depending on the display size. This type of display may be more reliable, more compact and have a reduced power consumption compared to an externally scanned matrix. The elimination of most of these external connections provides enough room on the substrate to make the remaining leads larger and, therefore, more reliable. This area is also available for implementing the data and scanning logic circuitry.

The Kawate patent also discusses an embodiment in which the data and select logic of an LCD display are integrated onto the same substrate as the display, and are implemented redundantly. The primary and redundant select logic are placed, respectively, at the left and right sides of the display, and the primary and redundant data logic are located respectively at the top and bottom of the display. If the shift register in the select logic on one side of the matrix has a defective stage, then the shift register on the opposite side of the device may be used instead. If, however, both select logic shift registers have defective stages then the portion of the display below the lower-most defective stage cannot be used since there is no way to apply a select pulse to the TFT's in those rows of the matrix.

SUMMARY OF THE INVENTION

The present invention is embodied in an LCD display having redundant integrated select scanner shift registers. A combiner circuit containing a fusable link is provided in between each consecutive pair of select shift register stages. In each of the redundant shift registers, the fusable link, when it is present, conditions the shift register to apply the signal from the stage coupled to one side of the combiner to the stage coupled to the other side. If, however, the fusable link of a shift register stage is broken, the signal applied to the stage of the shift register at the output of the combiner is not from the previous stage but from a different stage of one of the redundant shift registers.

DETAILED DESCRIPTION

Figure 1:
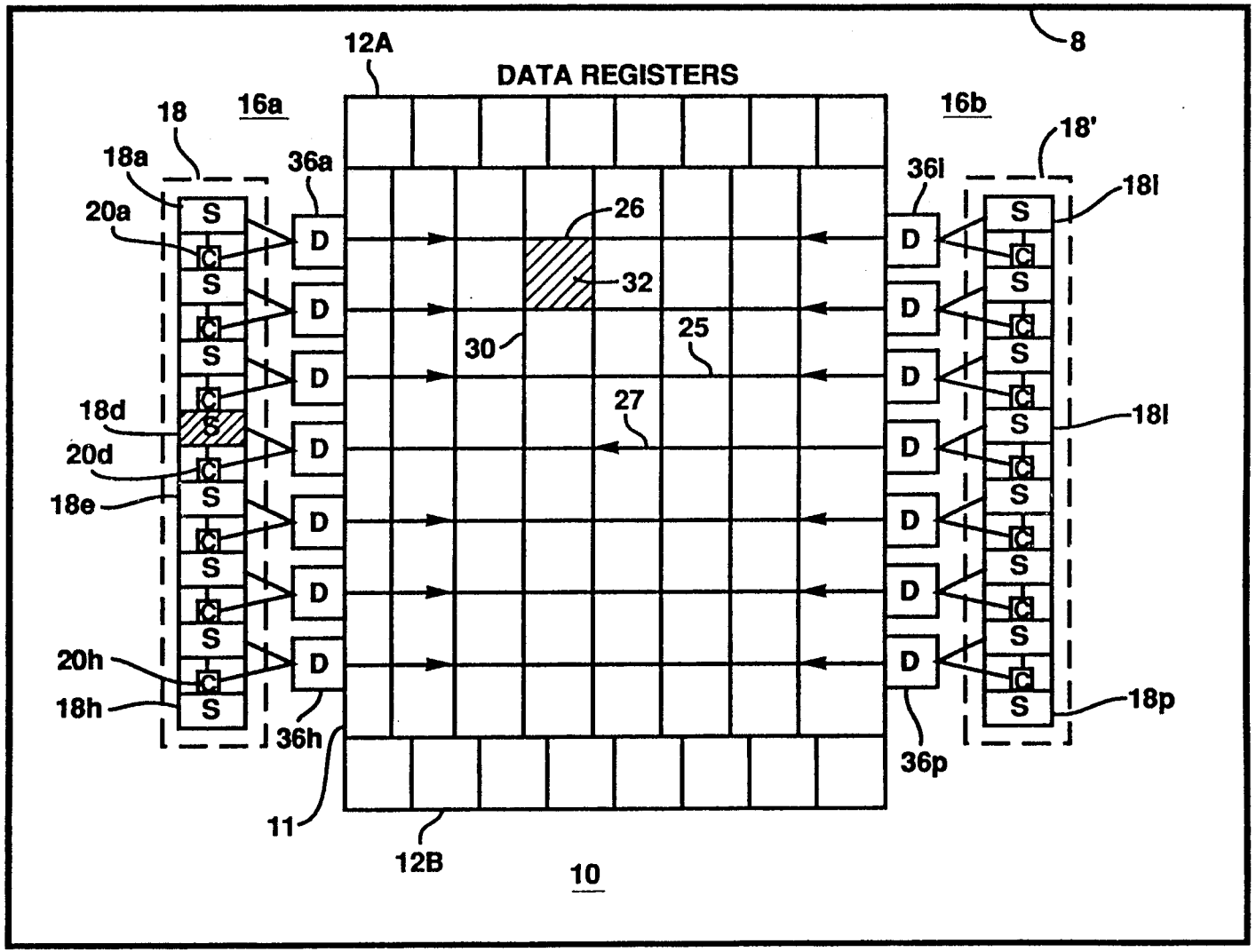
FIG. 1 is a block diagram of an LCD display which includes an embodiment of the present invention.

FIG. 1 shows an LCD display 10 in which redundant select scanners 16*a*, 16*b* and redundant data registers 12*a*, 12*b* are integrated with the LCD array 11 on the substrate 8. Select scanners 16*a* and 16*b* include respective select shift register 18 and 18′ in which the individual stages (18*a*–18*p*) are joined by combining circuitry (20*a*–20*p*). The stages of the shift registers are coupled to respective driver circuits 36*a*–36*p* which are coupled to the select lines 26 of the LCD array 11.

The select lines 26 are conductively coupled to corresponding stages of the two select shift register stages 18 and 18′ and to combiners 20. For example, in the first stages of the two shift registers, a single select line 26 is coupled, through the driver circuits 36*a* and 36*i*, to the respective shift register stages 18*a* and 18*i*. The line 26 is also coupled to the combining circuits 20*a* and 20*i*. The Combining circuits are configured to couple successive stages of each of the shift registers 18 and 18′. Data lines 30 are provided, one data line per column of pixels in the display. A pixel cell 32 is located at the intersection of each gate line 26 and data line 30. Each pixel cell includes an LCD and an associated TFT switching device (not shown). The select and data circuitry are formed in the same steps as the TFT switching devices.

Following formation of the LCD array, data circuitry 10 and select circuitry 16*a* and 16*b* on the LCD substrate 8, the circuitry is tested to detect defective paths or devices. Of particular interest is the detection and repair of defects in the select shift register stages 18*a*–18*p*. As the first line of the display is activated, a select voltage value (e.g. 15 volts) is stored in the shift register stage 18*a* for the first line. Driver circuit 36*a* provides this select voltage to the gate line 26. All of the other stages 18*b*–18*h* contain a non-select value (zero), and the other drivers 36*b*–36*p* provide a non-select gate voltage value. When this line has been scanned, the select voltage value is stored in the stage 18*b* for the next line and a zero value is stored in the first stage 18*a*. The select signal thus propagates through the shift register 18 as the LCD lines are sequentially scanned. In the absence of a shift register defect, the combiner circuits 20*a*–20*p* have no impact on the propagation of the select bit through shift register 18.

A defect in any of the stages 18*a*–18*h* can prevent the propagation of the select signal through the shift register 18, and thus prevent the selection and scanning of the display lines below the defect. It is an objective of the present invention to increase the yields of LCD display devices by introducing structures which tolerate defects in either select scanner 16*a* or 16*b*.

In the simplest case, where there are no defects in either select scanner 16*a* or 16*b*, the second scanner is truly redundant, and both scanners or either one of the scanners can drive the display line. Equally simple is the case where any defects in the select scanners 16*a*, 16*b* are confined to one of the two scanners. In this instance, the connections to the scanner containing the defects can be severed with a laser and the operational scanner may still be used.

If however, there are defects in both select scanners 16*a* and 16*b* which prevent normal propagation of the select bit through either one of the shift registers 18 or 18′, it is desirable to combine shift register stages 18*a*–18*p* from both scanners 16*a* and 16*b*, so that at least one operable stage is provided for each line of the LCD 10. The present invention provides this capability through a laser repair to the combiner 20 below each defective shift register stage. In the following discussion, shift register stage 18*d* in FIG. 1 will be assumed to be defective.

In a first exemplary embodiment of the invention, a repair of the combiner 20*d* configures the stage 18*e* in scanner 16*a* to receives the select signal from stage 181 in scanner 16*b*, instead of from stage 18*d* immediately above stage 18*e*. In the same way, it is possible to repair an operable LCD with multiple select scanner shift register defects. Since each display line is provided with combiner circuits 20 for both select scanners 18, it is possible to use any combination of functional shift register stages 18*a*–18*p* (at least one per select line from either side of the display), so long as one stage is operable for each line. A fully functional display can be recovered even though up to half of the select shift register stages 18*a*–18*p* from each side of the display are defective.

Figure 2:
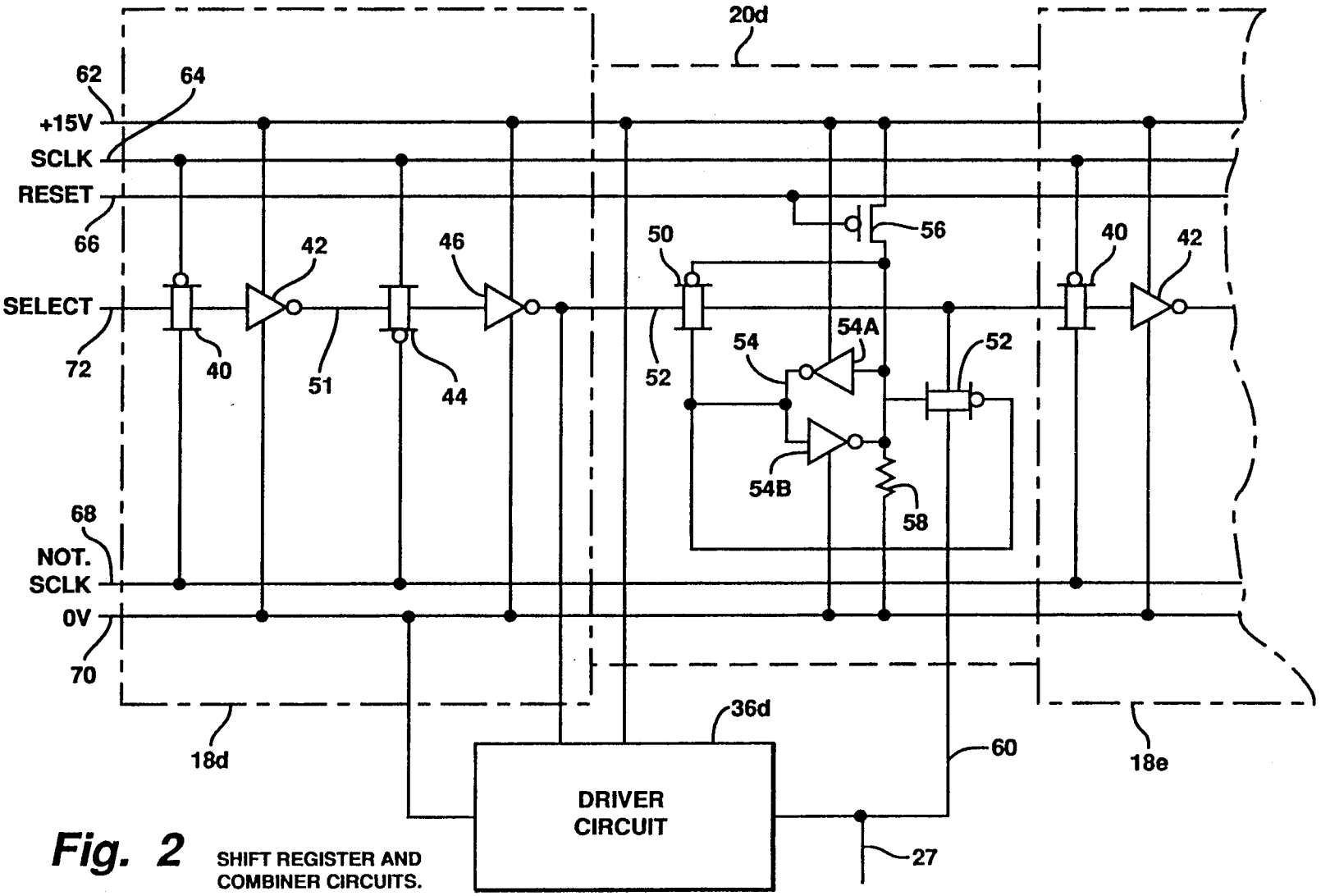
FIG. 2 is a block diagram showing details of the combiner and shift register of the LCD display shown in FIG. 1.

FIG. 2 is a block diagram showing details of a typical combiner circuit 20*d* and select shift register stage 18*d* of the LCD shown in FIG. 1. The driver circuit 36*d* is of a conventional type known to those skilled in the art and is not described here in detail. The shift register stage 18*d* includes pass gates 40 and 44 and CMOS inverters 42 and 46 forming a dynamic-logic master-slave flip-flop which is clocked by signal SCLK and its inverse, NOT.SCLK. The SELECT signal, SCLK and NOT.SCLK are provided to pass gate 40. When SCLK pulses low at the P-channel gate and NOT.SCLK is high at the N-Channel gate, SELECT (an active high signal), is provided to pass gate 40 and inverted by inverter 42 to provide signal S1. The value of S1 is stored in the gate capacitance (not shown) of inverter 42. Pass gate 44 does not pass signal S1 while SCLK is low. When SCLK pulses high and NOT.SCLK is low, pass gate 40 is turned off and pass gate 42 is turned on, allowing signal S1 to pass through gate 42 to inverter 46. The voltage level is inverted to S2, which is stored in inverter 46 and output to both combiner 20 and driver 36.

Combiner circuit 20*d* receives signal S2 from shift register stage 18*d* and also receives a shift register stage value from line 60, which conductively couples combiner 20*d* and select line 27. Combiner 20*d* only provides one of these two signals to the next shift register stage 18*e*.

FIG. 2 shows the configuration for the combiner circuit 20*d* when no laser repairs are made. The combiner comprises transfer gates 50 and 52, a latch 54 which includes 2 CMOS inverters 54*a* and 54*b*, a fusable link 58, and a reset gate 56.

Reset gate 56 is normally turned off, so that the 15 volt signal 62 is not applied to the latch 54. The conductive path between fusable link 58 and latch 54 causes the output signal of the inverter 54A to be high and the output signal of the inverter 54B to be low. In this configuration, a low signal is applied to the N-channel gate of transfer gate 52 and a high signal is applied to the P-channel gate of transfer gate 52. These signals turn off transfer gate 52, so that the select line signal on line 60 is not passed through gate 52. Also in this configuration, the signals provided by the latch 54 apply a low signal to the P-channel gate of transfer gate 50 and apply a high signal to the N-channel gate of transfer gate 50. This turns on transfer gate 50, so that the output signal, signal S2 of the shift register stage 18*d* is passed through gate 50 to the input terminal of the shift register stage 18*e*. So long as shift register stage 18*d* is operable, this combiner configuration is appropriate for passing the select bit from shift register stage 18*d* to 18*e*.

If, however, a problem is detected in shift register stage 18*d* during testing, it is desirable to take the value applied to the shift register stage 18*e* from another stage besides 18*d*. A laser can be used to melt away fusable link 58 from combiner 20*d*. A RESET pulse may be applied from an external source to line 66 to turn on reset gate 56. Responsive to this signal, a high signal from line 62 is applied to the input terminal of inverter 54A, causing the output signals provided by the inverters 54A and 54B to be low and high, respectively. These signals turn off the transmission gate 50 and turn on the transmission gate 52.

Thus, when the fusable link connection 58 is broken, the combiner 20*d* will no longer pass the select bit from shift register stage 18*d* to stage 18*e*. It will instead pass the select bit from the corresponding shift register stage 181 of the shift register 18′ on the other side of the LCD display. This signal is provided via select line 27 and line 60.

Figure 3:
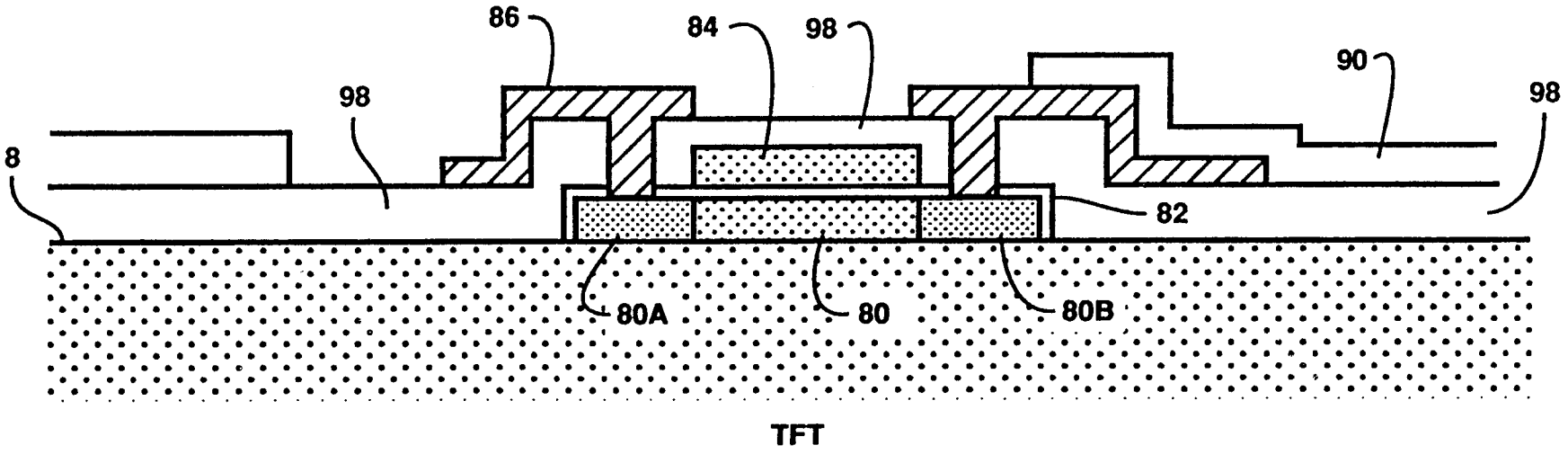
FIG. 3 is a cross sectional side elevation view of the TFT configuration of the LCD display shown in FIG. 1.

FIG. 3 is a cross sectional side elevation view of the TFT configuration of the LCD shown in FIG. 1. TFT 34 is formed as follows: an 800–1500 Angstrom layer of low temperature (560 degrees Celsius) deposited silicon 80 is deposited on substrate 8. This layer can serve as the bottom pixel electrode. After the silicon is patterned, an 800 Angstrom thick thermal oxide ($SiO_2$) is grown to serve as a gate insulator 82. Polysilicon material is deposited at 560 degrees Celsius and patterned. This polysilicon material serves both as the select (gate) line 26 as well as the TFT gate 84. For a p-type transistor, a boron implant is used to dope the source 80*a* and drain 80*b* regions. For an n-type transistor, source 80*a* and drain 80*b* are ion implanted with phosphorous. For both p and n transistors, the gate material 84 is heavily doped n-type with phosphorous. The implant is activated in steam, yielding a polysilicon gate having a sheet resistance of 100 Ohms per square. The substrate 8 is then coated with a layer of low temperature $Si_3N_4$ glass 98 followed by a layer of doped oxide. This layer of glass serves as the dielectric for the display pixel. Next, contacts are opened through the oxide and dielectric layers and aluminum metalization 86 is deposited and defined. A layer of indium-tin oxide is deposited as the top pixel electrode.

Figure 4:
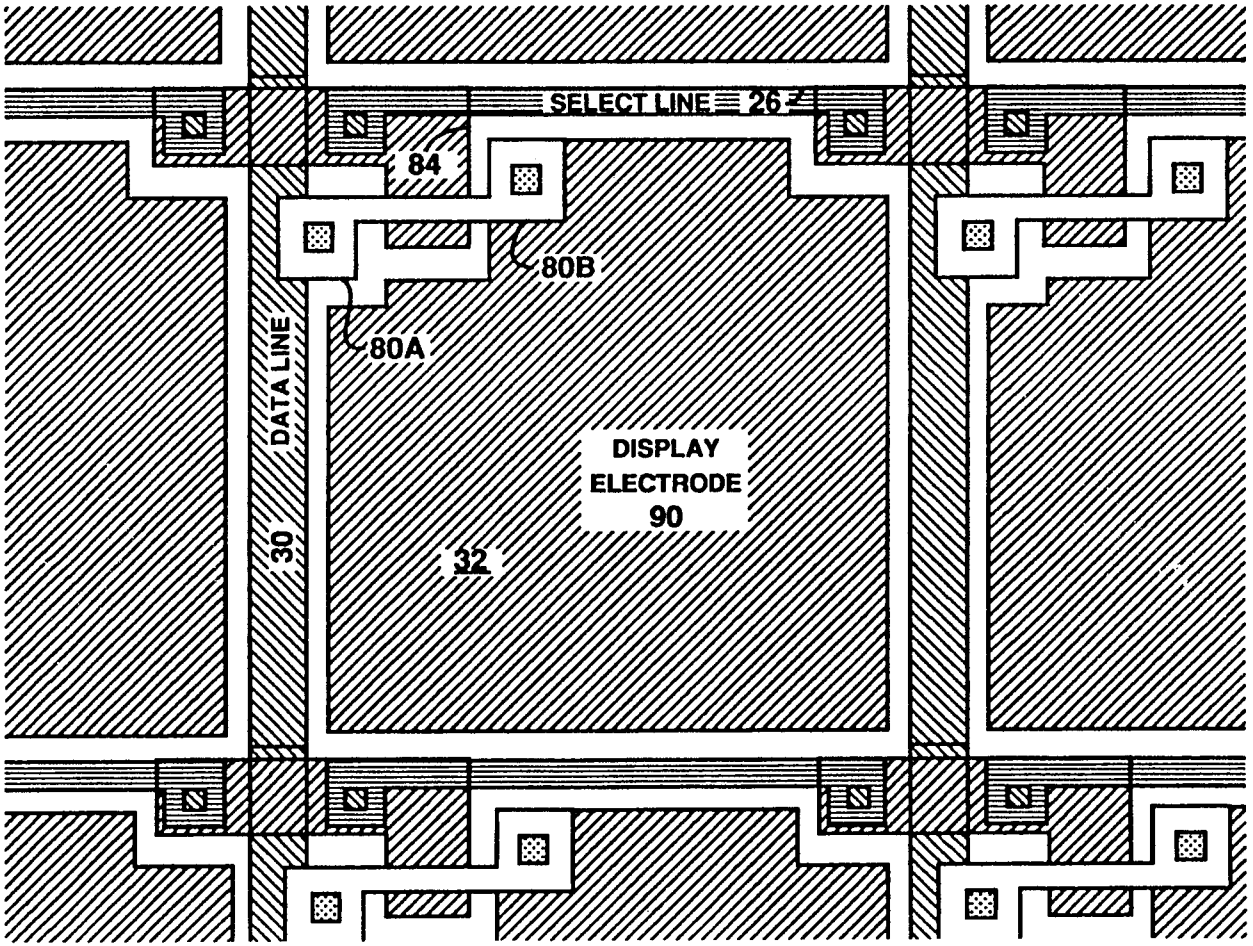
FIG. 4 is a plan view showing an enlarged view of an LCD pixel element in the LCD display shown in FIG. 1.

FIG. 4 is a plan view showing an enlarged view of a portion of the LCD shown in FIG. 1. A pixel 32 is provided at the intersection of each select line 26 and data line 30. Each pixel includes a TFT device 34 and a display electrode 90. The select lines 26, data lines 30 and the TFT 34 occupy a relatively small portion of the LCD area, enhancing resolution. The aluminum metalization 86 provides the data lines 30 for the LCD 10. In addition, the polysilicon select (gate) lines 26 are also coated with aluminum during the same metalization process used to deposit the data lines, except in the vicinity of the data lines. This metalization is electrically connected to the underlying polysilicon conduction paths of the select lines 26 to provide a shunt path that enhances the reliability of the select lines.

A second embodiment of the invention is useful in relatively large displays, in which appreciable resistance-capacitance (RC) delays might be encountered by a signal propagating along select line 26 from one side of the display to the other. In these large displays, it may be desirable to pick up the select signal from a shift register stage which is closer to the top of the display than the immediately preceding stage. The choice of the shift register stage to be used can thus be optimized to match the performance of a display with no defects in the select scanner. In the example set forth above, the line 60 would be coupled to receive the select signal from the line 25, coupled to stage 18*k* of the shift register 18′ rather than from the line 27 which is coupled to the stage 181.

A third embodiment of the invention is contemplated in which the combiner circuit 20*d* would provide electronic rerouting of the select bit from one of the redundant shift register stages in response to external application of a reset pulse. Testing would still be performed in the same manner as for the first embodiment of the invention, but following fault detection, laser repairs would not be required to compensate for a detective shift register stage, instead, a special potential applied as the select signal or a combination of the select signal and the reset pulse would condition the combining circuit to reroute the select signal around the defective stage.

An enhanced version of the third embodiment is also contemplated, in which a fail-safe circuit within the combiner 20 is used to detect and compensate for a defective shift register stage without repair or disconnection. This fail safe circuit would detect conditions such as a select shift register stage stuck on or stuck high or stuck low and reroute the signal from the select line 26 automatically. In order to minimize the complexity of this failsafe circuit, it may be desirable to limit the number of defect types which are to be automatically detected. In this instance, an undetected defect may be corrected by laser repair as set forth above.

Figure 5:
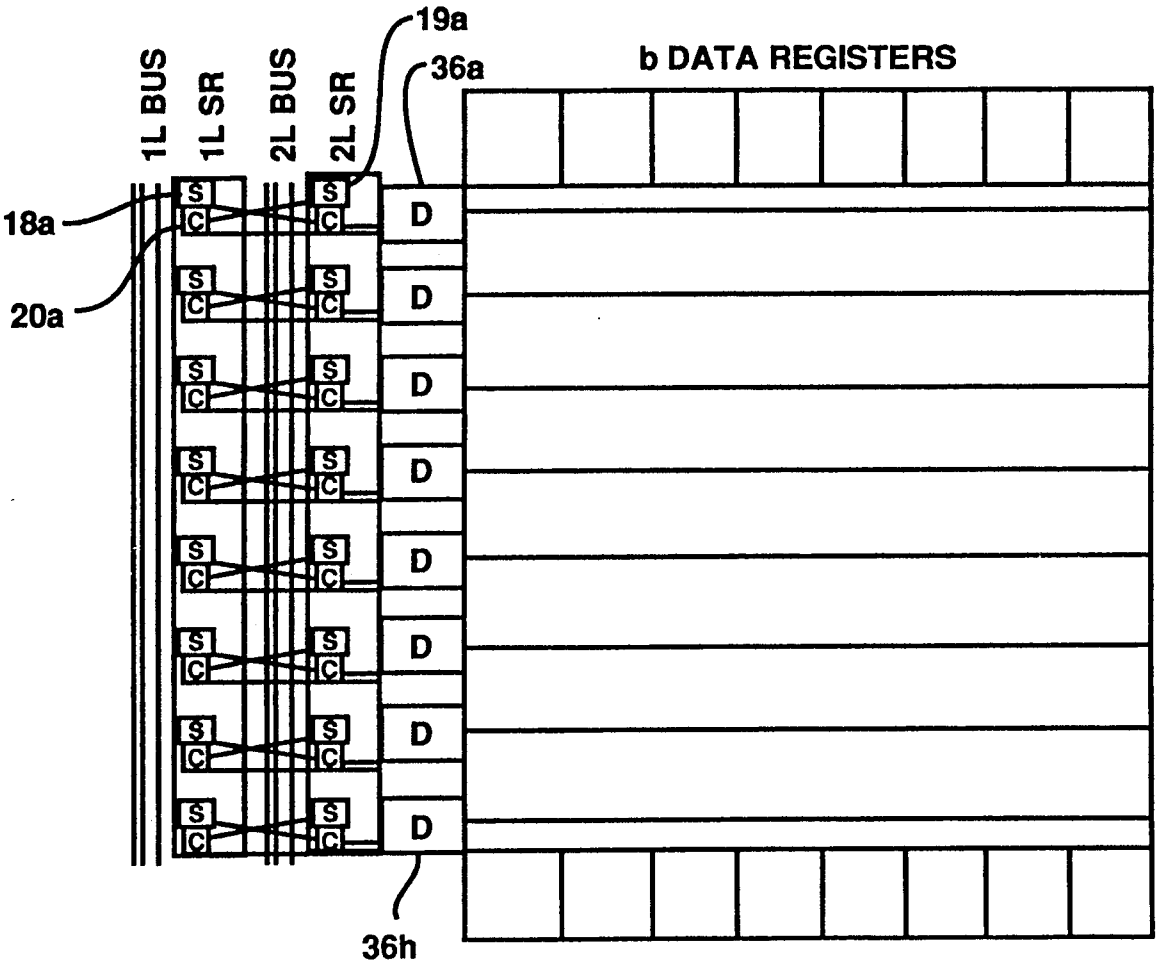
FIG. 5 is a block diagram showing an LCD display which uses an alternate embodiment of the present invention.

A block diagram of an LCD which uses a fourth embodiment of the present invention is shown in FIG. 5. In this embodiment, a second complete shift register 19 is added in parallel with and on the same side of the LCD display as the shift register 18. In this embodiment of the invention, the shift register 18' may be eliminated. This shift register 19 is sufficiently separated from shift register 18 so that a single defect (e.g. a speck of duct on a mask) is unlikely to affect the stages associated with the both register stages that drive a single select line.

This fourth embodiment has two potential advantages relative to the first embodiment. First, only half as many driver circuits are required. Either shift register 18, shift register 19 or a combination of stages from both shift registers is sufficient to perform the scanning function with a single column of driver circuits 36. This represents a savings in both the number of devices and the total area of the display.

The other advantage is that when the select bit signal is rerouted from register 19 to register 18, there are no RC delays due to propagation of the signal across the select line 26. As noted in the discussion of the first embodiment the connection of the auxiliary input to the combiner circuit may have to be specially routed to compensate for these RC delays. However, in this configuration, there is only one driver for each scan line while the previous embodiment had redundant driver circuits. In addition, in this embodiment of the invention, it is not possible to use the select circuitry on both sides of the display to compensate for a broken scan line. Moreover, a relatively large defect which affects both shift registers 18 and 19 may render the display inoperable.

Figure 6:
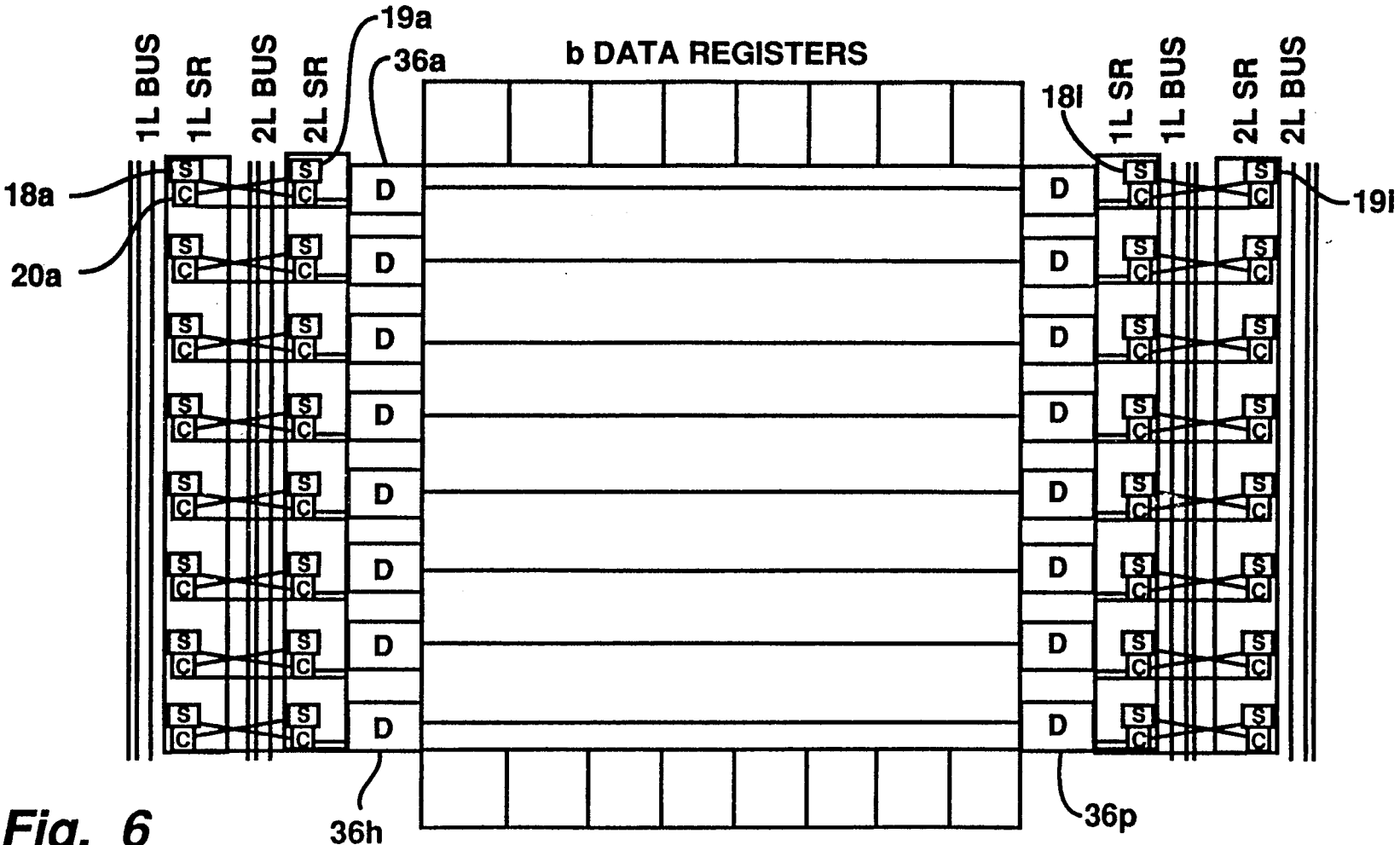
FIG. 6 is a block diagram showing an LCD display which uses another alternate embodiment of the present invention.

FIG. 6 is a block diagram showing an LCD which uses a fifth embodiment of the present invention. In this embodiment, there are two pairs of shift registers 18, 19 and 18' and 19', respectively, positioned on either side of the LCD display 10. In addition, there is a a complete column of driver circuits 36 on each side of the LCD display. This embodiment provides all of the features of the fourth embodiment, with greater redundancy. In addition, since the left shift register and drive circuits are physically remote from the right shift register and drive circuits, the likelihood of a single defect affecting the same stage in all of the shift registers is substantially smaller.

The main disadvantages of this method relative to the other embodiments are the number of extra devices used to form the four complete shift registers, and the concomitant increase in area.

While the invention has been described in terms of exemplary embodiments, it is contemplated that it may be practiced as outlined above with modifications within the spirit and scope of the appended claims.

The Invention claimed is:

1. In a scanned active matrix display including an array of selectable pixel cells arranged in a matrix having in a plurality of rows and a plurality of columns, wherein each pixel cell is addressed by selecting one of said rows of pixel cells and one of said columns of pixel cells, apparatus for redundantly selecting individual rows of pixel cells comprising:

shift register means having a plurality of stages, each coupled to a respectively different row of pixel cells, for successively applying a first select signal to each row of pixel cells;

alternate select means for successively applying a second select signal to each row of pixel cells; and a plurality of combiner means, coupled to said plurality of stages of said shift register, respectively, and to said alternate select means for selectively applying said first select signal or said second select signal to the respective next stages of said shift register.

2. The apparatus set forth in claim 1 wherein:

said means for successively applying a second select signal to each row of pixel cells includes further shift register means having a plurality of stages, each coupled to a respectively different row of said pixel cells; and each of said combiner means has first and second input terminals coupled, respectively to corresponding stages in said shift register means and said further shift register means.

3. The apparatus set forth in claim 2 wherein the corresponding stages of said shift register means and said further shift register means are separated by respectively different ones of said plurality of rows of pixel cells.

4. The apparatus set forth in claim 2 wherein said shift register means and said further shift register means are positioned adjacent to each other and to a predetermined end of said plurality of rows of pixel cells.

5. The apparatus set forth in claim 1 wherein:

each of said combining means is configured to pass said first select signal to the relative exclusion of said second select signal; and each of said combining means includes a fusable link which may be disconnected by a pulse of laser light to condition said combining means to pass said second select signal to the relative exclusion of said first select signal.

6. The apparatus set forth in claim 2 wherein said active matrix display includes an array of light conducting cells each including liquid crystal material and each including a thin-film transistor for selectively activating said liquid crystal material, said thin-film transistor being fabricated in a set of process steps, wherein said shift register and said further shift register include thin-film transistors which are made using the process steps used to fabricate the thin-film transistors in said light conducting cells.

7. The apparatus set forth in claim 6 wherein:

each of said thin-film transistors includes a gate electrode and a primary conductive channel fabricated from polysilicon and a metallic conductor for coupling said primary conductive path to said other thin-film transistors in a column of said pixel cells; and the gate electrodes of the transistors in each of said plurality of rows of pixel cells are connected by a conductive path fabricated from polysilicon and having portions shunted by conductive paths formed from said metallic conductor.

8. The apparatus set forth in claim 2 wherein:

said shift register means includes first and second component shift register means, each having a plurality of stages for applying said first select signal and a redundant first select signal to each row of pixel cells; and each stage of each of said first and second component shift register means has an input terminal and a component combiner means coupled to selectively apply said first select signal or said redundant first select signal to said input terminal.

9. In a scanned liquid crystal active matrix display including an array of addressable liquid crystal device (LCD) pixel cells arranged in a matrix having in a plurality of rows, wherein said LCD pixel cells are activated by sequentially selecting each of said rows of pixel cells, apparatus for redundantly selecting individual rows of pixel cells comprising:

first shift register means having a plurality of stages, each having an input terminal and an output terminal, wherein each of said output terminals is coupled to the input terminal of the next successive stage and to a respectively different one of said plurality of rows of LCD pixel cells, for successively applying a first select signal to each of said plurality of rows of pixel cells;

second shift register means having a plurality of stages, each having an input terminal and an output terminal, wherein each of said output terminals is coupled to the input terminal of the next successive stage and to a respectively different one of said plurality of rows of pixel cells, for successively applying a second select signal to each of said plurality of rows of pixel cells;

a plurality of first combiner means, each having a first input terminal coupled to the output terminal of a respectively different one of the plurality of stages of said first shift register means and a second input terminal coupled to the output terminal of a respectively different one of the plurality of stages of said second shift register means, for selectively applying one of said first and second select signals to the respective next successive stages of said first shift register means; and a plurality of second combiner means, each having a first input terminal coupled to the output terminal of a respectively different one of the plurality of stages of said second shift register means and a second input terminal coupled to the output terminal of a respectively different one of the plurality of stages of said first shift register means, for selectively applying one of said second and first select signals to the respective next successive stages of said second shift register means.

* * * * *